US006468156B1

(12) United States Patent
Hughs-Baird et al.

(10) Patent No.: US 6,468,156 B1
(45) Date of Patent: Oct. 22, 2002

(54) MAXIMUM BONUS PAY SCHEDULE METHOD AND APPARATUS FOR A GAMING MACHINE

(75) Inventors: Andrea C. Hughs-Baird; Steven G. LeMay, both of Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/264,250

(22) Filed: Mar. 8, 1999

(51) Int. Cl.[7] ..... A63F 9/22

(52) U.S. Cl. ..... 463/25; 463/20; 463/21; 463/26

(58) Field of Search ..... 463/16–22, 25–28

(56) References Cited

U.S. PATENT DOCUMENTS

| | | | | | |
|---|---|---|---|---|---|
| 4,991,848 | A | * | 2/1991 | Greenwood et al. | 273/143 R |
| 5,116,055 | A | * | 5/1992 | Tracy | 273/138 A |
| 5,123,649 | A | * | 6/1992 | Tiberio | 273/143 R |
| 5,294,120 | A | | 3/1994 | Schultz | |
| 5,401,024 | A | * | 3/1995 | Simunek | 273/138 A |
| 5,423,539 | A | * | 6/1995 | Nagao | 273/143 R |
| 5,494,287 | A | * | 2/1996 | Manz | 273/143 R |
| 5,564,700 | A | * | 10/1996 | Celona | 463/27 |
| 5,655,961 | A | * | 8/1997 | Acres et al. | 463/27 |

FOREIGN PATENT DOCUMENTS

| | | |
|---|---|---|
| EP | 0521599 A1 | 1/1993 |
| WO | WO98/52659 | 11/1998 |

* cited by examiner

*Primary Examiner*—Valencia Martin-Wallace
*Assistant Examiner*—Carmen D. White
(74) *Attorney, Agent, or Firm*—Beyer Weaver & Thomas, LLP

(57) ABSTRACT

A method and subsystem for paying awards in a gaming machine having a Bet Module adapted to configure the gaming machine to have a plurality of discrete Bet Values (BV) available to a game user. A Pay Table Module is further included which is configured to provide a plurality of associated payout awards which vary with the bet value wagered, wherein a discrete bonus Bet Value ($BV_{bonus}$), which commences a maximum bonus pay schedule ($X_{bonus}$), may be adjustably selected from at least two of the discrete bet values.

24 Claims, 4 Drawing Sheets

| | BONUS SCHEDULE |
|---|---|
| PAY TABLE A | less than max coins bet = 250/coin bet<br>max coins bet = 800/coin bet |
| PAY TABLE B | 1-4 coins bet = 250/coin bet<br>5-9 coins bet = 300/coin bet<br>10-19 coins bet = 350/coin bet<br>20-29 coins bet = 400/coin bet<br>30-39 coins bet = 450/coin bet<br>40-49 coins bet = 500/coin bet<br>50-74 coins bet = 600/coin bet<br>75-99 coins bet = 700/coin bet<br>maximum bonus = 800/coin bet |

| PRIOR ART PAYOUT SCHEDULE | | | |
|---|---|---|---|
| | OPERATOR SETS 5 COIN MAX BET | OPERATOR SETS 20 COIN MAX BET | OPERATOR SETS 100 COIN MAX BET |
| PAY TABLE A | 1-4 coins bet = 250/coin bet<br>5th coin bet = 800/coin bet | 1-19 coins bet = 250/coin bet<br>20th coin bet = 800/coin bet | 1-99 coins bet = 250/coin bet<br>100th coin bet = 800/coin bet |
| PAY TABLE B | 1-4 coins bet = 250/coin bet<br>5th coin bet = 800/coin bet | 1-4 coins bet = 250/coin bet<br>5-9 coins bet = 300/coin bet<br>10-19 coins bet = 350/coin bet<br>20th coin bet = 800/coin bet | 1-4 coins bet = 250/coin bet<br>5-9 coins bet = 300/coin bet<br>10-19 coins bet = 350/coin bet<br>20-29 coins bet = 400/coin bet<br>30-39 coins bet = 450/coin bet<br>40-49 coins bet = 500/coin bet<br>50-74 coins bet = 600/coin bet<br>75-99 coins bet = 700/coin bet<br>100 coin bet = 800/coin bet |

*FIG. 2*

PRESENT INVENTION PAYOUT SCHEDULE

| | OPERATOR SETS 5 COIN MAX BET & 3 COIN MAX BONUS START | OPERATOR SETS 20 COIN MAX BET & 15 COIN MAX BONUS START | OPERATOR SETS 100 COIN MAX BET & 25 COIN MAX BONUS START |
|---|---|---|---|
| SCHEDULE A 24 | 1-2 coins bet = 250/coin bet<br>3-5 coins bet = 800/coin bet 24 | 1-14 coins bet = 250/coin bet<br>15-20 coins bet = 800/coin bet | 1-24 coins bet = 250/coin bet<br>25-100 coins bet = 800/coin bet 24 |
| PAY TABLE B | 1-2 coins bet = 250/coin bet<br>3-5 coins bet = 800/coin bet 24 | 1-4 coins bet = 250/coin bet<br>5-9 coins bet = 300/coin bet<br>10-14 coins bet = 350/coin bet<br>15-20 coins bet = 800/coin bet 24 | 1-4 coins bet = 250/coin bet<br>5-9 coins bet = 300/coin bet<br>10-19 coins bet = 350/coin bet<br>20-24 coins bet = 400/coin bet<br>25-100 coins bet = 800/coin bet 24 |

*FIG. 4*

MAXIMUM BONUS PAY SCHEDULE METHOD AND APPARATUS FOR A GAMING MACHINE

TECHNICAL FIELD

This present invention relates, generally, to gaming devices and, more particularly, relates to more flexible pay table schedules and subsystems for gaming machines.

BACKGROUND ART

In the recent past, gaming machines have become increasingly sophisticated. The once traditional mechanically-driven reel slot machines are often replaced with electronic counterparts having CRT video displays or the like. Moreover, these video/electronic gaming advancements enable the operation of more complex gambling games which would not otherwise be possible on mechanical-driven gambling machines. Such stand alone video electronic games include Keno, Blackjack, Poker, Pai Gow, and all the variations thereof.

More recently, multiple game platforms have been developed which provide access to multiple electronic games through a single stand alone gaming machine, such as International Game Technology's (IGT) "Game King Machine". These games are usually stored in Erasable, Programmable, Read-Only Memory (EPROM) chip sets which are then incorporated into compatible gaming machines for operation thereof. A game selection menu may be provided on the video display which offers the patron the choice of one or more video/electronic games. The gaming patron, thus, may select a gambling game of their choice without having to search the gaming establishment for the location of a desired game.

Not only have the games increased in sophistication, but so have the methodologies and schemes employed to award a winning gaming patron. As with a substantial majority of the gambling games and gaming devices, if not all, the gaming patron has the option of proportionately increasing their wager with the potential of increasing their pay schedule. However, various techniques are currently employed to further encourage the gaming patron to maximize their wager by offering a bonus pay table schedule based upon the number of coins bet.

As shown in the Bonus Schedule Table of FIG. 1, two exemplary pay table schemes are provided, both schedules of which may be incorporated in any gaming machine. Pay Table A represents a two-tiered scheme in which the gaming patron is eligible for a maximum bonus pay schedule when they wager the maximum number of coins bet on a single game, a number predetermined by the gaming operator.

This concept may best be illustrated in Pay Table A of FIG. 2 in which a five (5) coin maximum bet amount is established. Upon a gaming patron wagering a 1 to 4 coin bet, a potential pay schedule of 250 coins per coin bet is scheduled. Hence, a one (1) coin wager will yield a 1×250 or 250 coin award, while a four (4) coin wager will yield a 4×250 or 1000 coin award, etc. However, should the gaming patron elect to be eligible for the maximum bonus pay schedule (i.e., 800 coins per coin bet), they were required to bet the maximum amount of coins accepted by the gaming machine (i.e., a five (5) coin wager). Upon wagering a fifth coin, the maximum bonus pay schedule of 800 coins per coin bet in Pay Table A is commenced which will yield a 5×800 or 4000 coin award.

In contrast, in the maximum bonus pay schedule of Pay Table B, a multi-tiered pay table scheme is devised which is increasingly graduated to further encourage increased wagering. In this scheme, the number of coins wagered which amount to less than a preset maximum coin bet provide a pay table of: 250 coins per coin bet from 1 to 4 coins bet; 300 coins per coin bet from 5 to 9 coins bet; 350 coins per coin bet from 10 to 19 coins bet; . . . ; 700 coins per coin bet from 75 to 99 coins bet. Upon the maximum coin being bet, E.g., the $100^{th}$ coin, a maximum bonus pay schedule of 800 coins per coin bet is awarded which amounts to a 100×800 or 80,000 coin award.

One problem associated with these present pay table arrangements is that they are relatively inflexible to encourage additional wagering. Under the current schemes and associated subsystems, a gaming operator may select the maximum number of coins wagered, but may not select when the maximum bonus pay schedule is to commence independent of the maximum number of coins wager. Therefore, the gaming patron is only eligible for the maximum bonus pay schedule when they wager the maximum coin wager. The maximum bonus pay schedule thus only occurs upon betting the maximum coin wager. In some instances, therefore, attempts to customize the wagering may actually reduce the patron incentive to increase their wager, rather than increase their incentive.

This may best be exemplified in the tables of FIG. 2. In the first column of the Schedules A and B, for example, a gaming operator may initially select the maximum coin bet at five (5) coins. Therefore, for coins 1 to 4 wagered by the gaming patron, an award of 250 coins per coin wagered may be achieved, while the maximum bonus (i.e., at 800 coins per coin bet) will not become effective until the fifth coin is bet by the gaming patron. However, should the gaming operator later select a maximum coin bet at 20 coins (col. 2 of the table in FIG. 2), then the maximum bonus pay schedule (i.e., at 800 coins per coin bet) will not become effective until and will automatically commence on the $20^{th}$ coin wagered by the gaming patron. In contrast, the remaining wagered coins from 1 to 19 coins correspond to a 250 coins per coin bet in Pay Table A, while in Pay Table B, 5 to 9 coins correspond to a 300 coins per coin bet, and 10 to 19 coins correspond to a 350 coins per coin bet.

Accordingly, while the $5^{th}$ coin waged in the 5 coin maximum wager game yielded a potential award of 800 coins per coin bet, the $5^{th}$ coin waged in the newly configured 20 coin maximum wager game now only yields 250 coins per coin bet for Pay Table A and 300 coins per coin bet for Pay Table B. To achieve an 800 coins per coin bet would not require a maximum wager of 20 coins. It is this inflexibility which may be problematic since customers frequenting the gaming machine with a previous 5 coin maximum wager schedule may be reluctant to utilize the gaming machines with the reconfigured 20 coin maximum wager schedules.

In addition, should a significant alteration in the Pay Table Schedule be requested, as above indicated, a new EPROM chip set incorporating the new scheme would have to be installed in the gaming machine. This inefficient method to alter the payscale may increase the gaming machine downtime (i.e., during installation), as well as cause higher operating costs for the gaming operator. The costs for the machine manufacturer or game vendor are also increased since they must supply several different EPROM chip sets having different combinations of pay table schedules.

This is a serious concern for gaming machine manufacturers and gaming vendors alike. Accordingly, in view of the above observations, it would be desirable to provide a multiple game platform gaming machine which can easily enable the gaming machine manufacturer or vendor to more flexibly control the pay table schemes of the selected games.

DISCLOSURE OF INVENTION

The present invention provides a subsystem and method for paying awards in a gaming machine including configuring the gaming machine to have a plurality of discrete Bet Values (BV) available to a game user and a plurality of associated pay table awards which vary with the bet value wagered, wherein a discrete bonus Bet Value ($BV_{bonus}$), which commences a maximum bonus pay schedule ($X_{bonus}$), may be adjustably selected from at least two of the discrete bet values.

In one embodiment, the configuring the gaming machine further includes inputting the maximum Bet Value ($BV_{max}$) independently from inputting the bonus Bet Value ($BV_{bonus}$) which may be performed by a gaming operator. $BV_{bonus}$ is the lowest bet value allowing the maximum payout award.

In another aspect of the present invention, a subsystem for paying awards in a gaming machine is provided including either discrete Bet Circuitry or general circuitry programmed with specific bet software (collectively referred to as a "Bet Module") adapted to configure the gaming machine to have a plurality of discrete Bet Values (BV) available to a game user. Pay Table Module Circuitry or general circuitry programmed with specific pay table software (collectively referred to as a "Pay Table Module"), is further included which is configured to provide a plurality of associated payout awards which vary with the bet value wagered. A discrete bonus Bet Value ($BV_{bonus}$), which commences a maximum bonus pay schedule ($X_{bonus}$), may be adjustably selected from at least two of the discrete bet values.

The Bet Module may include a discrete bonus Bet Value (BV) adapted to commence the maximum payout award when the game user reaches the bonus Bet Value ($BV_{max}$). Further the Bet Module may include a discrete maximum Bet Value ($BV_{max}$) configured to limit the bet value, where the bonus $BV_{bonus}$ is less than or equal to the maximum $BV_{max}$.

In another aspect, the associated payout awards are provided by a first pay table schedule corresponding to BVs less than the bonus $BV_{bonus}$, and a second pay table schedule corresponding to BVs ranging from the bonus $BV_{bonus}$ to the maximum $BV_{max}$. The associated payout award and the maximum payout award may be based upon multiples of the bet value.

In another embodiment, the bet values are based upon coin denominations, and the associated payout award and the maximum payout award are also based upon coin multiples of the coin denomination.

In yet another embodiment, a subsystem for paying awards in a gaming machine including a maximum Bet Module adapted to selectively set a maximum dollar amount bet on a game based upon a discrete maximum Bet Value ($BV_{max}$) of a plurality of discrete Bet Values (BV) ranging from $BV_1$ to $BV_{max}$ bet by a game user during a single game. $BV_{max}$ is to be independently selected by a gaming operator. The general Pay Table Module is also provided which is adapted to award a general payout ($P_{general}$) upon the game user attaining predetermined parameters during a single game. The general payout is determined by an equation of:

$$P_{general}=(Y_{general})(BV_{bet}),$$

when the Bet Value of the game user ($BV_{bet}$) for a single game is such that $BV_{bet}<BV_{bonus}$. $BV_{bonus}$ is be independently adjustable and selected by the gaming operator, and where $BV_1<BV_{bonus}<BV_{max}$. Further, $Y_{general}$ is the general pay schedule awarded per $BV_{bet}$. This present embodiment further includes a maximum bonus Pay Table Module adapted to selectively and independently adjust the $BV_{bonus}$ at which the maximum bonus pay schedule ($X_{bonus}$) commences. The maximum bonus payout is then determined by the equation of:

$$P_{bonus}=(X_{bonus})\ (BV_{bet}),$$

when the $BV_{bet}$ is in the range of $BV_{bonus}\leqq BV_{bet}\leqq BV_{max}$. As mentioned, $X_{bonus}$ is the maximum bonus pay schedule awarded per $BV_{bet}$, and $X_{bonus}>Y_{general}$.

$X_{bonus}$ and $Y_{general}$ are preferably based upon multiples of BV. $Y_{general}$ is preferably increasingly graduated relative the increasing $BV_{bet}$ bet by the game user, and the BVs are provided by coin denominations.

BRIEF DESCRIPTION OF THE DRAWINGS

The method and assembly of the present invention has other objects and features of advantage which will be more readily apparent from the following description of the Best Mode of Carrying Out the Invention and the appended claims, when taken in conjunction with the accompanying drawing, in which:

FIG. 2 is a table of two prior art pay table schedules incorporating the pay table schemes of FIG. 1.

FIG. 4 is a table of pay table awards of the present invention incorporating the pay table schemes of FIG. 1.

BEST MODE OF CARRYING OUT THE INVENTION

Figures 1, 3:
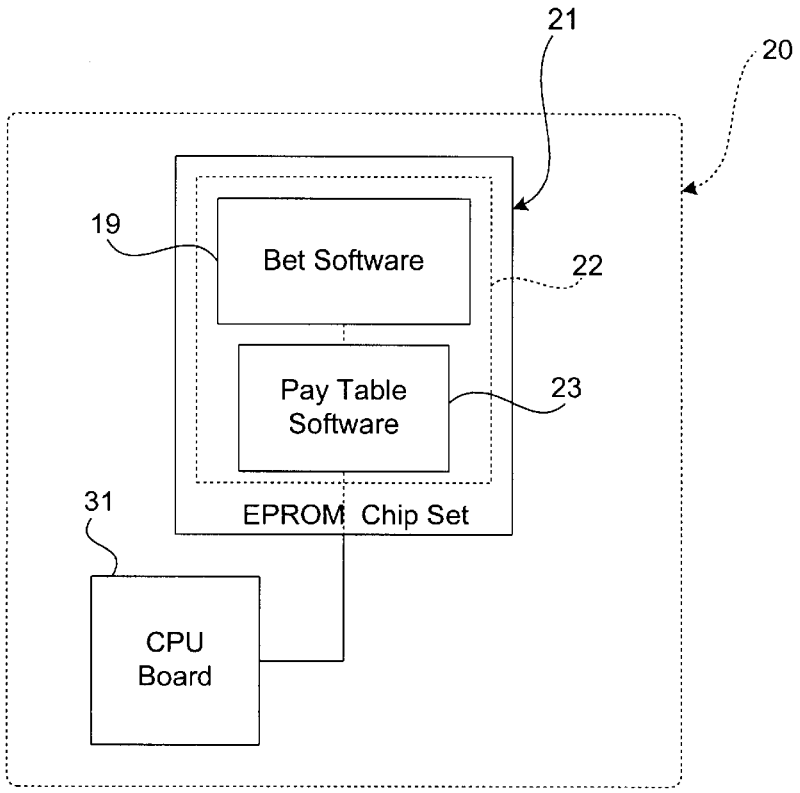
FIG. 1 is a table of two conventional pay table schemes employed in gaming machines having a maximum bonus award.
FIG. 3 is a schematic representation of a gaming device incorporating a EPROM chip set having a pay table subsystem constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIG. 3 which represents a schematic diagram of a gaming machine, generally designated 20, incorporating an EPROM chip set 21 including the subsystem 22 of the present invention for paying awards in a gaming machine. The subsystem 22 includes Bet Module 19 adapted to configure the gaming machine 20 to have a plurality of discrete Bet Values (BV) (e.g., the number of coins bet by the game user) available to a game user. Pay Table Module 23 is further included in subsystem 22 which is configured to provide a plurality of associated pay schedule awards which vary with the Bet Value wagered, such as those represented in the table of FIG. 4. In accordance with the present invention, a discrete bonus Bet Value ($BV_{bonus}$), which commences a maximum bonus pay schedule ($X_{bonus}$), may be adjustably selected from at least two of the discrete bet values.

More specifically, unlike the current pay table awards and subsystems, the present invention provides increased flexibility to customize the pay table awards by enabling the machine manufacturer, gaming vendor or gaming operator to more easily select at what discrete bonus Bet Value ($BV_{bonus}$) wagered the associated maximum bonus pay schedule ($X_{bonus}$ set forth below) will commence. That is, for each pay combination which meets the predetermined parameters of a game for award eligibility, the game operator may selectively and independently control the value of the minimum wager required to institute the maximum bonus pay schedule ($X_{bonus}$). This selection of the $BV_{bonus}$, when the maximum bonus pay schedule commences, can be adjusted and is independent of the selection of the maximum Bet Value ($BV_{max}$) or maximum wager. In the current industry wide pay table awards and associated subsystems, in contrast, the bonus Bet Value ($BV_{bonus}$) wager is fixed and usually occurs at the maximum Bet Value ($BV_{max}$).

Such a pay table scheduling method and subsystem are especially suitable for multiple video game formats operated from a single gaming machine since the pay tables awards can be customized for each game. Substantially increased pay table award flexibility may thus be provided without requiring EPROM chip set replacement. Hence, the number of multiple game EPROM chip sets incorporating different pay table awards may be significantly reduced which subsequently reduces manufacturing costs.

Note that the invention is not limited to the structure illustrated in FIG. 3. The invention applies to any physical system (not just on EPROM chip set) that can store and use a flexible bonus schedule of the type described herein. Briefly, embodiments of the present invention as described above employ various operations involving data stored in computer systems or processor of video devices and encoder devices for example. Useful machines for performing the operations of this invention include digital computing systems or other data processing devices. Such apparatus may be specially constructed for the required purposes, or it may be a general purpose computing systems selectively activated or reconfigured by a computer program stored in the computer. The processes presented herein are not inherently related to any particular computing system or other apparatus. In particular, various general purpose machines may be used with programs (including programmed EPROMs for example) written in accordance with the teachings herein, or it may be more convenient to construct a more specialized apparatus to perform the required method steps. The required structure for a variety of these machines will appear from the description given above.

In addition, embodiments of the present invention further relate to computer readable media that include program instructions for performing various computer-implemented operations. The media and program instructions may be those specially designed and constructed for the purposes of the present invention, or they may be of the kind well known and available to those having skill in the computer software arts. Examples of computer-readable media include, but are not limited to, magnetic media such as hard disks, floppy disks, and magnetic tape; semiconductor memory, optical media such as CD-ROM disks; magneto-optical media such as optical disks; and hardware devices that are specially configured to store and perform program instructions, such as read-only memory devices (ROM) such as flash memory devices, EEPROMs, EPROMs, etc. and random access memory (RAM). Examples of program instructions include both machine code, such as produced by a compiler, and files containing higher level code that may be executed by the computer using an interpreter.

Figure 5:
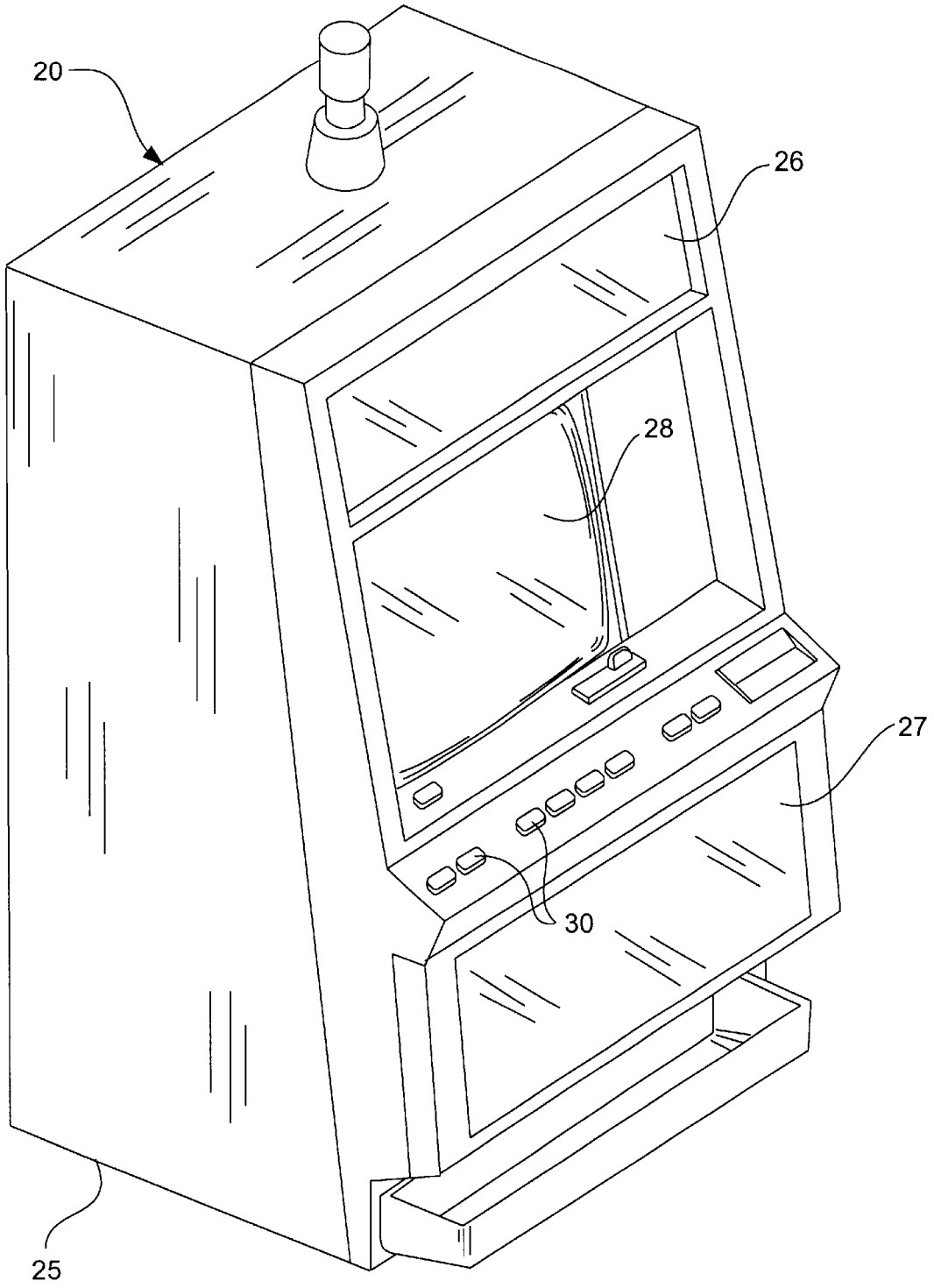
FIG. 5 is a top perspective view of a conventional gaming machine incorporating the pay table subsystem of the present invention.

Referring to FIG. 5, a conventional video display gaming machine 20 is provided in accordance with one embodiment of this invention which is capable of supporting a multi-game machine format, such as International Game Technology's (IGT) "Game King Machine". Gaming machine 20 may include a gaming machine housing 25, a top glass 26, a belly glass 27, and a main video display 28. Main video display 28 may be provided by high-resolution flat panel Liquid Crystal Displays (LCD), Cathode Ray Tubes (CRT), projection type LCDs, plasma displays, field emission displays, digital micromirror devices (DMD) or other conventional electronically controlled video monitors. Examples of games for which the results of a play may be displayed on a main video display include video slot games, electronic video poker card games, electronic keno games, electronic blackjack games, spinning reel slot games, and increasingly popular multi-line machines which have multiple (e.g., 8 or 15) pay lines.

Provided beneath main display 28 are various play buttons 30 which allow the user to control operation of the gaming machine in a conventional manner. The control buttons 30 allow the gaming machine user to select various games and/or game options. Of course, the arrangement and function of control buttons 30 will depend somewhat upon the type of game (or games) that can be played on machine 20, and buttons 30 may have more than one function depending on the available games. Also, a touch screen (not shown) may be included in Gaming Machine 20 permitting the user to activate functions through the use of "buttons" displayed on the screen at appropriate times.

The host gaming machine 20 preferably includes a CPU board 31 (FIG. 3) having the necessary processors and memory to execute the coded instructions to operate the multitude of available games. The CPU board 31 also executes the coded instructions to customize the pay table award for each game in accordance with the present invention. The processor will, of course, act on these instructions to generate the appropriate signals.

The subsystem 22 of the present invention is preferably incorporated in EPROM chip set 21 which is configured to be compatibly installed into gaming machine 20. Preferably, each chip set includes a set of game chips which provide the specific information to operate the available games for display and operation on the gaming machine. Briefly, incorporated in these memory chips are the instruction sets and graphics necessary for game operation of each game of the multiple game format. These chips also incorporate subsystem 22 which is a set of pay table/configuration instruction sets providing coded data for pay table schemes, button operation and various menu operations. It is these instructions, of course, in which the present invention resides.

As best viewed in FIGS. 3 and 4, the present invention may be described in detail. More specifically, a subsystem 22 is provided for paying awards in a gaming machine 20 including maximum Bet Module 19 adapted to selectively set a maximum dollar or credit amount bet on a game based upon a discrete maximum Bet Value ($BV_{max}$) of a plurality of discrete Bet Values (BV) ranging from $BV_1$ to $BV_{max}$ bet by a game user during a single game. $BV_{max}$, which as mentioned relates to the maximum wager the game user may bet, is to be independently selected by a gaming operator. For example, for a gaming machine requiring a one dollar denomination wager, the maximum wager may be ten (10) dollars. It will further be understood that the term "dollar" and "credit" are to be used interchangeably.

General Pay Table Module 23 is also provided which is adapted to award a general payout ($P_{general}$) upon the game user attaining predetermined parameters during a single game. These predetermined parameters, for example, would correspond to a jackpot in slot machine game or a royal flush in a video poker game. The general payout is determined by an equation of:

$$P_{general}=(Y_{general})(BV_{bet}),$$

when the Bet Value wagered by the game user ($BV_{bet}$) for a single game is such that $BV_{bet}<BV_{bonus}$. $BV_{bonus}$ is to be independently selected and adjusted by the gaming operator, and is of a value of $BV_1<BV_{bonus}<BV_{max}$. Further, $Y_{general}$ is the general pay schedule awarded per $BV_{bet}$, and is generally a multiple of the discrete Bet Value (BV).

When the amount wagered by the game user (i.e., $BV_{bet}$) is in the range of $BV_{bonus}\leqq BV_{bet}\leqq BV_{max}$, the maximum bonus payout ($P_{bonus}$) is determined by the equation of:

$$P_{bonus}=(X_{bonus})(BV_{bet}),$$

where $X_{bonus}$ is the maximum bonus pay schedule awarded per $BV_{bet}$ wagered, and where preferably $X_{bonus}>Y_{general}$. Similar to $Y_{general}$, $X_{bonus}$ is preferably based upon multiples of the BV.

Briefly, the Bet Values (BV) are defined as the discrete wager amounts which a game user may wager during or at the commencement of a single game. Hence, a Bet Value may be provided by any incremental credit unit, chip, currency denomination or the like which functions as a wager. For the ease of description, the Bet Value will generally be described as a "coin" such as a quarter, half-dollar or dollar coin. Moreover, it will be appreciated that these pay table schemes may be applied to any predetermined parameters of a game, such as a "blackjack" in the game of "Blackjack"; a "royal-flush" or a "full-house" each in the game of "Poker"; or a "jackpot" in a slot machine game.

In the preferred form, $Y_{general}$ is preferably increasingly graduated relative to the increasing $BV_{bet}$ bet by the game user as set forth in the example of Pay Table B of FIG. 1. For descriptive purposes and for the ease of description, however, the present invention will initially be described with reference to Pay Table A of FIG. 1 which illustrates a simple two-tiered approach. It will be appreciated that any pay table schedule may be incorporated into the present invention to increase the customization flexibility of the pay table award. Further, the present invention will better be explained with reference to the coin values for the Bet Values (BV) for the ease of understanding.

In Pay Table A, the equation for the general payout award (i.e., $P_{general}=(Y_{general})(BV_{bet})$) is 250 coins multiplied by the number of coins wagered, or 250 (coins/coins bet)× (coins bet). Thus, $Y_{general}$=250 coins/coin bet, while $BV_{bet}$ is the number of coins wagered or coins bet. Similarly, when the game user wagers at least the bonus Bet Value ($BV_{bonus}$), the maximum bonus pay schedule ($X_{bonus}$) commences for the maximum payout award equation 24 (i.e., $P_{bonus}=(X_{bonus})(BV_{bet})$), and is 800 coins multiplied by the number of coins wagered, or 800 coins per coins bet. Thus, $X_{bonus}$= 800 coins/coin bet. In the past pay table schemes, as. mentioned, $BV_{bonus}$ usually occurred at $BV_{max}$, or some other fixed value.

In accordance with the present invention, the two-tiered scheme of Pay Table A is incorporated in the scheme of the present invention, examples of which are illustrated in the table of FIG. 4. Using the main display screen 28 of the gaming machine of FIG. 5 and an associated menu generated by the instruction set of the present invention, the gaming operator may initially set the maximum Bet Value (i.e., $BV_{max}$) at five (5) coins. Accordingly, in this arrangement, the gaming patron will be limited to at most a five coin wager. Further, in accordance with the present invention, the gaming operator may independently set the bonus Bet Value (i.e., $BV_{bonus}$) at three (3) coins.

Hence, incorporating these values into the pay table scheme of the present invention, the discrete Bet Value (BV) of the game user ranges from $BV_1$ to $BV_{max}$, or one (1) coin to five (5) coins. The general payout equation of $P_{general}=(Y_{general})(BV_{bet})$ is $P_{general}$=250 (coins/coin bet) multiplied by the number of coins bet. As set forth in the table of FIG. 4 and according to the present invention, this occurs when the wager of the game user ($BV_{bet}$) for a single game is in the range of $1\leqq BV_{bet}<3$ (i.e., $1\leqq BV_{bet}<BV_{bonus}$) where $BV_{bonus}$ is equivalent to three (3) coins. Thus, for one (1) or two (2) coins bet, the potential payout or award would be 250×1=250 coins, or 250×2=500 coins, respectively.

However, as an incentive to wager more, should the game user bet in the range of $3\leqq BV_{bet}\leqq 5$ (i.e., $BV_{bonus}\leqq BV_{bet}\leqq BV_{max}$), the maximum bonus payout equation applies (i.e., $P_{bonus}=(X_{bonus})(BV_{bet})$) where $P_{bonus}$=800 (coins/coin bet) multiplied by the number of coins bet. Thus, for three (3) coins bet, the potential payout would be 800×3=2400 coins, and for five (5) coins wagered, the potential award would be 800×5=4000 coins.

It will be appreciated that in accordance with the present invention, the bonus Bet Value ($BV_{bonus}$) for a five (5) coin maximum Bet Value ($BV_{max}$.) can be anywhere in the range of $1<BV_{bonus}\leqq 5$. Thus, this feature substantially increases the payout award flexibility since the commencement of the maximum bonus pay schedule award ($X_{bonus}$) may be adjusted to apply at one of a plurality of Bet Values independent of $BV_{max}$. This arrangement benefits both the game machine and/or game manufacturer and the gaming operator alike.

Similarly, in the second example for Pay Table A of FIG. 4, the gaming operator may initially set $BV_{max}$ at twenty (20) coins so that the gaming patron will be limited to at most a twenty coin wager. Further, in accordance with the present invention, the gaming operator may independently set $BV_{bonus}$ at fifteen (15) coins, for example.

Hence, incorporating these values into the pay table scheme of the present invention, the general payout equation of $P_{general}$=250 (coins/coin bet)×($BV_{bet}$) for coins wagered from one (1) to fourteen (14), or in accordance with the present invention, when $BV_{bet}$ is in the range of $1\leqq BV_{bet}<15$ (i.e., $1\leqq BV_{bet}<BV_{bonus}$). Similarly, should the game user bet in the range of $15\leqq BV_{bet}\leqq 20$. (i.e., $BV_{bonus}\leqq BV_{bet}\leqq BV_{max}$.), the maximum bonus payout equation applies where $P_{bonus}$=800 (coins/coin bet)×($BV_{bet}$). Thus, for seventeen (17) coins bet, the potential payout would be 800×17=13,600 coins, and for twenty (20) coins wagered, the potential award would be 800×20=16,000 coins.

Referring now to Pay Table B of FIG. 1, a preferred multi-tiered pay table scheme is shown where the $Y_{general}$ is increasingly graduated as the game user increases their wager. Similar to Pay Table A, the equation for the general payout award is $P_{general}=(Y_{general})(BV_{bet})$. When $BV_{bet}$ ranges from 1 to 4 coins, $Y_{general}$=250 coins/coin bet, while for wagers from 5 to 9 coins, $Y_{general}$=300 coins/coin bet, etc. Similarly, in this scheme, when the game user wagers at least the bonus Bet Value ($BV_{bonus}$), the maximum bonus pay schedule ($X_{bonus}$) commences for the maximum payout award 24 (i.e., $P_{bonus}=(X_{bonus})(BV_{bet})$), and is 800 coins multiplied by the number of coins wagered, or 800 coins per coins bet. Thus, $X_{bonus}$=800 coins/coin bet. In the past schemes, as mentioned, $BV_{bonus}$ always occurred at $BV_{max}$.

Referring back to the table of FIG. 4, the results of the present invention are illustrated where Pay Table B is incorporated therein. Manipulating the buttons 30 and the associated menu (not shown) on display screen 28 of the gaming machine 20 (FIG. 5), the gaming operator may initially set the maximum Bet Value (i.e., $BV_{max}$) at twenty (20) coins, for example. Further, in accordance with the present invention, the gaming operator may independently select a bonus Bet Value (i.e., $BV_{bonus}$) of fifteen coins (15) coins.

Incorporating these values into the pay table scheme of the present invention, the discrete Bet Value (BV) of the game user ranges from $BV_1$ to $BV_{max}$, or one (1) coin to twenty (20) coins. The general payout equation of $P_{general}=(Y_{general})(BV_{bet})$ is $P_{general}$=250 (coins/coin bet) multiplied by the number of coins bet. As set forth in the table of FIG. 4 and according to Pay Table B of FIG. 1, this occurs when the wager of the game user ($BV_{bet}$) for a single game is in the ranges from 1 to 4 coins. Similarly, a wager of 5 to 9 coins also yields a pay schedule which mirrors Pay Table B (i.e., $P_{general}$=300 (coins/coin bet) ($BV_{bet}$)). Thus, for two (2) coins bet, the potential pay schedule would be 250×2=500 coins, while for nine (9) coins wagered, the potential pay schedule would be 300×9=2,700 coins.

According to Pay Table B of FIG. 1, a wager between ten (10) to nineteen (19) coins provides a $Y_{general}$=350 coins/coin bet. However, in this example, since the gaming operator selected the bonus Bet Value (i.e., $BV_{bonus}$) at fifteen (15) coins, only between ten (10) to fourteen (14) coins wagered does $Y_{general}$=350 coins/coin bet (i.e., $BV_{bet}<BV_{bonus}$, where $BV_{bonus}$ is 15 coins). Should the game user bet in the range of $15 \leqq BV_{bet} \leqq 20$. (i.e., $BV_{bonus} \leqq BV_{bet} \leqq BV_{max}$.), the maximum bonus payout equation (i.e., $P_{bonus}=(X_{bonus})(BV_{bet})$) supercedes the general payout equation, where $P_{bonus}$=800 (coins/coin bet) multiplied by the number of coins bet. For instance, for eighteen (18) coins bet, the potential award would be 800×18=14,400 coins.

In contrast, should the gaming operator elect to change the maximum Bet Value ($BV_{max}$) to 100 coins, the $BV_{bonus}$ can be selected anywhere in the range of $1<BV_{bonus} \leqq 100$. In the third Pay Table B example of the table of FIG. 4, the bonus Bet Value ($BV_{bonus}$) is selected as twenty-five (25) coins. Thus, coins wagered from 1 to 24 coins follow the pay schedule of Pay Table B of FIG. 1. Should the game user, however, bet in the range of $25 \leqq BV_{bet} \leqq 100$. (i.e., $BV_{bonus} \leqq BV_{bet} \leqq BV_{max}$.), the maximum bonus payout equation (i.e., $P_{bonus}=(X_{bonus})(BV_{bet})$) again supercedes the general payout equation, where $P_{bonus}$=800 (coins/coin bet) multiplied by the number of coins bet.

In the preferred embodiment of the present invention, the instruction set for the maximum bonus payout ($P_{bonus}$) equation supercedes the instruction set of the general payout equation ($P_{general}$), when applicable. Accordingly, CPU board 31 executes the Pay Table A or B instruction set, for example, until the maximum bonus payout equation instruction set applies. This of course commences when $BV_{bonus} \leqq BV_{bet} \leqq BV_{max}$, such that the maximum bonus payout equation supercedes the general payout equation.

In the instance where a graduated pay table schedule, such as Pay Table B is applied and $X_{bonus}$ of the maximum bonus payout equation (i.e., $P_{bonus}=(X_{bonus})(BV_{bet})$) is less than $Y_{general}$ of the general payout equation of $P_{general}=(Y_{general})(BV_{bet})$, the larger of the two award values will supercede the smaller award value (not shown). For example, using the application of Pay Table B, if $X_{bonus}$ were only 650 coins/coin bet, and $BV_{bonus}$ was selected at 30 coins, the maximum bonus payout equation only applies until the $74^{th}$ coin bet. Upon the $75^{th}$ coin wagered by the game user, the general pay table equation of $P_{general}=(Y_{general})(BV_{bet})$ would supercede $P_{bonus}$ since when BV is 75 to 100 coins wagered, $Y_{general}>X_{bonus}$. Thus, the general payout equation instruction set will supercede the maximum bonus payout equation instruction set.

In another aspect and as apparent from the description of the present invention, a method is provided for paying awards in a gaming machine 20 including configuring the gaming machine 20 to have a plurality of discrete Bet Values (BV) available to a game user and a plurality of associated pay table awards which vary with the BV wagered. The present inventive method further a discrete bonus Bet Value ($BV_{bonus}$), which commences a maximum bonus pay schedule ($X_{bonus}$), may be adjustably selected from at least two of the discrete bet values.

The configuring the gaming machine preferably further includes inputting the maximum Bet Value ($BV_{max}$) independently from inputting the bonus Bet Value ($BV_{bonus}$) which may be performed by a gaming operator.

What is claimed is:

1. A subsystem for paying awards in a gaming machine comprising:

a maximum Bet Module that selectively set a maximum amount wagered on a game based upon a discrete maximum Bet Value ($BV_{max}$) of a plurality of discrete Bet Values (BV) ranging from $BV_1$ to $BV_{max}$ wagered by a game user during a single game, where $BV_{max}$ is independently selected by a casino operator;

a general Pay Table Module that awards a general payout ($P_{general}$) in accordance with a general pay schedule ($Y_{general}$)upon the game user attaining predetermined parameters during a single game, said general payout being determined by an equation of:

$$P_{general}=(Y_{general})(BV_{bet}),$$

when the wagered Bet Value ($BV_{bet}$) of the game user for a single game is such that $BV_{bet}<BV_{bonus}$, where $BV_1<BV_{bonus} \leqq BV_{max}$, and where $Y_{general}$ is the general pay schedule awarded per $BV_{bet}$; and a maximum bonus Pay Table Module that selectively and independently set a maximum bonus payout ($P_{bonus}$) in accordance with a maximum bonus pay schedule ($X_{bonus}$) upon the game user attaining said predetermined parameters during said single game, and upon the game user wagering at least $BV_{bonus}$, where $BV_{bonus}$ is a minimum wager by the game user, independently and adjustably selected from at least two of the plurality of discrete Bet Values (BV), by the casino operator, necessary to commence application of the maximum bonus pay schedule ($X_{bonus}$), wherein said general pay schedule ($Y_{general}$) is superceded by the maximum bonus pay schedule ($X_{bonus}$), said maximum bonus payout being determined by the equation of:

$$P_{bonus}=(X_{bonus})(BV_{bet}),$$

when the $BV_{bet}$ is in the range of $BV_{bonus} \leqq BV_{bet} \leqq BV_{max}$, where $X_{bonus}$ is the maximum bonus pay schedule awarded per $BV_{bet}$.

2. The subsystem according to claim 1 wherein, said $X_{bonus}$ and $Y_{general}$ are based upon multiples of BV.

3. The subsystem according to claim 1 wherein, said $Y_{general}$ is increasingly graduated relative the increasing $BV_{bet}$ bet by the game user.

4. The subsystem according to claim 3 wherein, said graduated $Y_{general}$ is substantially linear.

5. The subsystem according to claim 1 wherein, said BVs are provided by coin denominations.

6. The subsystem according to claim 5 wherein, said $X_{bonus}$ and $Y_{general}$ are based upon coin multiples of the coin denomination.

7. The subsystem according to claim 1 wherein, said subsystem is provided by a chip set formed for incorporation into the gaming machine.

8. The subsystem according to claim 2 wherein, $$X_{bonus}>Y_{general}.$$

9. A method of commencing payment of bonus payment awards in a gaming machine comprising:

configuring the gaming machine to receive a wager from a game user, represented by a user wagered Bet Value ($BV_{bet}$) selected from one of a plurality of discrete Bet Values ($BV_{bet}$) available to a game user to wager;

providing a general pay schedule ($Y_{general}$) having a plurality of associated general payout awards ($P_{general}$) which vary depending upon the user wagered Bet Value ($BV_{bet}$);

providing a maximum bonus pay schedule ($X_{bonus}$) having a plurality of associated maximum bonus payout awards ($P_{bonus}$) depending upon the user wagered Bet Value ($BV_{bet}$); and enabling a casino operator to adjustably select a minimum wager, represented by a discrete bonus Bet Value ($BV_{bonus}$) selected from at least two of the plurality of discrete Bet Values ($BV_{bet}$), which commences application of the maximum bonus pay schedule ($X_{bonus}$) and supersedes the general pay schedule ($Y_{general}$).

10. The method of claim 9 wherein, said maximum bonus payout award commences at a discrete bonus bet value different from a discrete maximum bet value ($BV_{max}$).

11. The method of claim 10 wherein, said configuring the gaming machine further includes inputting the discrete maximum bet value ($BV_{max}$) independently from inputting the bonus bet value.

12. The method of claim 9 wherein, the associated general payout awards are graduated.

13. The method of claim 9 wherein, at least one of the associated general payout awards and the associated maximum bonus payout awards are based upon multiples of the bet value.

14. The method of claim 9 wherein, said bet values are provided by coin denominations.

15. The method of claim 14 wherein, the associated payout awards are based upon coin multiples of the coin denomination.

16. A subsystem for paying awards in a gaming machine comprising:

a Bet Module for the gaming machine configured to set a plurality of discrete Bet Values ($BV_{bet}$) upon which a game user may wager, represented by a user wagered Bet Value ($BV_{bet}$) selected from one of the plurality of discrete Bet Values ($BV_{bet}$); and a Pay Table Module including a general pay schedule ($Y_{general}$) having a plurality of associated general payout awards ($P_{general}$) which vary depending upon the user wagered Bet Value ($BV_{bet}$), and a maximum bonus pay schedule ($X_{bonus}$) having a plurality of associated maximum bonus payout awards ($P_{bonus}$) depending upon the user wagered Bet Value ($BV_{bet}$), wherein the Pay Table Module is that enables a casino operator to adjustably select a minimum wager, represented by a discrete bonus Bet Value ($BV_{bonus}$) selected from at least two of the plurality of discrete Bet Values ($BV_{bet}$), which commences application of the maximum bonus pay schedule ($X_{bonus}$) and supercedes the general pay schedule ($Y_{general}$).

17. The subsystem according to claim 16 wherein, said Bet Module further includes a discrete maximum bet value ($BV_{max}$) configured to limit the bet value.

18. The subsystem according to claim 17 wherein, said bonus bet value is less than said maximum bet value.

19. The subsystem according to claim 17 further including:

a customization module to enable the casino operator to adjust the bonus bet value independent of the maximum bet value.

20. The subsystem according to claim 16 wherein, said Pay Table Module graduates the associated general payout awards.

21. The subsystem according to claim 15 wherein, at least one of the associated general payout awards and the associated maximum bonus payout awards are based upon multiples of the bet value.

22. The subsystem according to claim 21 wherein, said bet values are provided by coin denominations.

23. The subsystem according to claim 22 wherein, at least one of the associated general payout awards and the associated maximum bonus payout awards are based upon coin multiples of the coin denomination.

24. The subsystem according to claim 16 wherein, said subsystem is provided by a chip set formed for incorporation into the gaming machine.

* * * * *